US005342988A

United States Patent [19]

Hsu et al.

[11] Patent Number: 5,342,988

[45] Date of Patent: Aug. 30, 1994

[54] STRUCTURE OF MUSIC BOX

[76] Inventors: Feng-Hsiang Hsu, Fl. 7, No. 9, Lane 100, Ho Chiang St.; Ching-Fa Huang, Fl. 2, No. 4, Lane 90, Sec. 1, Chih Yuan I Rd., both of Taipei, Taiwan

[21] Appl. No.: 49,357

[22] Filed: Apr. 21, 1993

[51] Int. Cl.[5] ..... G10F 1/06

[52] U.S. Cl. ..... 84/95.1

[58] Field of Search ..... 84/95.1, 95.2, 98

[56] References Cited

U.S. PATENT DOCUMENTS 5,020,409 6/1991 Hou ..... 84/95.2

5,070,753 12/1991 Hou ..... 84/95.2

5,161,420 11/1992 Feng ..... 84/95.2 X

*Primary Examiner*—Michael L. Gellner

*Assistant Examiner*—Patrick J. Stanzione

[57] ABSTRACT

A music box is disclosed including at least one cam coupled to the central shaft of the pinned barrel thereof and driven by it to move ornaments carried on a movable device. According to one embodiment of the present invention, the at least one cam includes two cams driven by the pinned barrel to reciprocate and rotate the movable device one after another.

4 Claims, 6 Drawing Sheets

STRUCTURE OF MUSIC BOX

BACKGROUND OF THE INVENTION

The present invention relates to a music box having a moving mechanism coupled to the central shaft of the pinned barrel thereof and driven by it to move ornaments variably upon the reproduction of music.

A variety of music boxes are known, and widely accepted by people of all ages. A normal music boxes generally has an ornament coupled to the shaft of the clock-work thereof and disposed above the casing. When the pinned barrel is driven by the clock-work to act against the metal comb, music is reproduced, and at the same time, the ornament is turned round and round above the casing. Because the rotary ornament can only make a rotary motion when the pinned barrel is rotated, little variation is produced to attract people.

SUMMARY OF THE INVENTION

The present invention has been accomplished under the aforesaid circumstances. It is therefore the main object of the present invention to provide a music box which drives a variety of ornaments to move in different directions as the music box is activated.

According to one embodiment of the present invention, a cam assembly is coupled to the central shaft of the pinned barrel and driven by it to reciprocate a rod, on which an ornament is supported. According to another embodiment of the present invention, two reciprocating rods are mounted on a movable board and driven by the cam on the central shaft of the pinned barrel. According to a third embodiment of the present invention, two cams are coupled to the central shaft of the pinned barrel and driven to reciprocate and rotate a movable board one after another, and therefore the ornament carried on the movable board is reciprocated and rotated at a variable direction and speed.

DETAILED DESCRIPTION OF THE PREFERRED EMBODIMENTS

Figure 1:
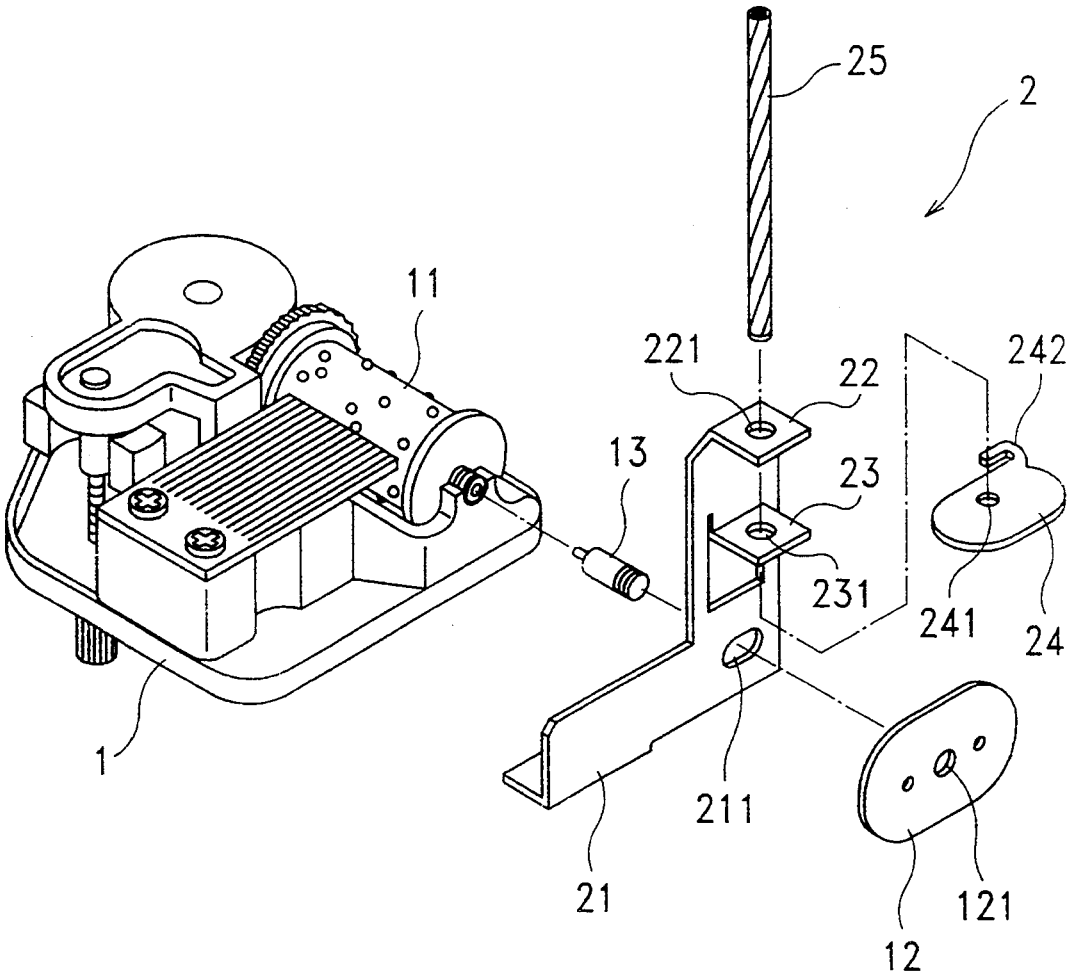
FIG. 1 is a perspective exploded view of the mechanical parts of a music box constructed according to a first embodiment of the present invention.

Referring to FIG. 1, the pinned barrel 11 of the music box 1 comprises an extension axle 13 longitudinally coupled to the central shaft of the barrel 11 thereof. The opposite end of the extension axle 13 fits into a center hole 121 on a cam 12. Therefore, turning on the pinned barrel 11 causes the extension axle 13 to turn the cam 12 round and round An upright frame 21 is fastened to the casing of the music box at one side. The upright frame 21 comprises an opening 211, through which the extension axle 13 passes and connects to the cam 12, an upper horizontal plate 22 at the top, which has a through hole 221, and a lower horizontal plate 23 between the upper horizontal plate 22 and the opening 211, which has a center through hole 231 aligned with the through hole 221 on the upper horizontal plate 22. A round rod 25 is inserted through the through holes 221 and 231 and fitted into a hole 241 on a movable board 24 above the cam 12. The movable board 24 has a hooked guide rod 242 hooked on the upright frame 21 at one side. As the pinned barrel 11 is activated by the clock-work to reproduce the music, the round rod 25 and the movable board 24 are reciprocated up and down by the cam 12, and therefore the ornament carried on the round rod 25 is synchronously moved up and down. The arrangement of the hooked guide rod 242 is to keep the movable board 24 be moved in the course.

Figure 2:
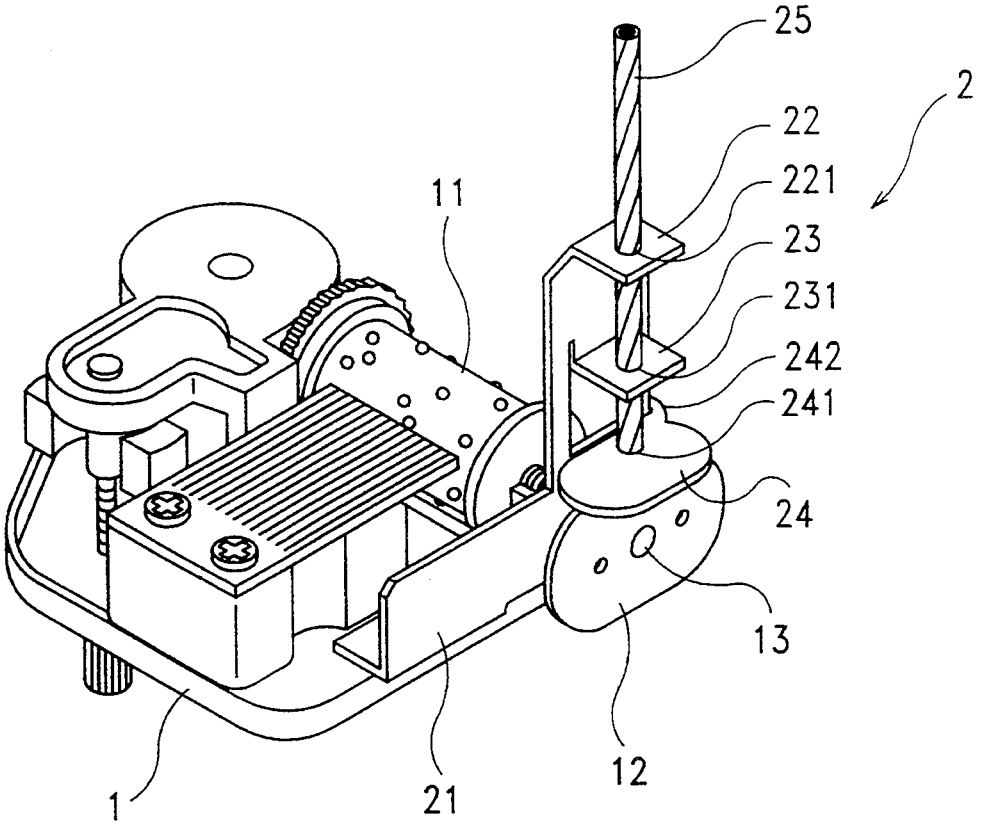
FIG. 2 is a perspective assembly view of the mechanical parts of the music box of FIG. 1.
Figure 3:
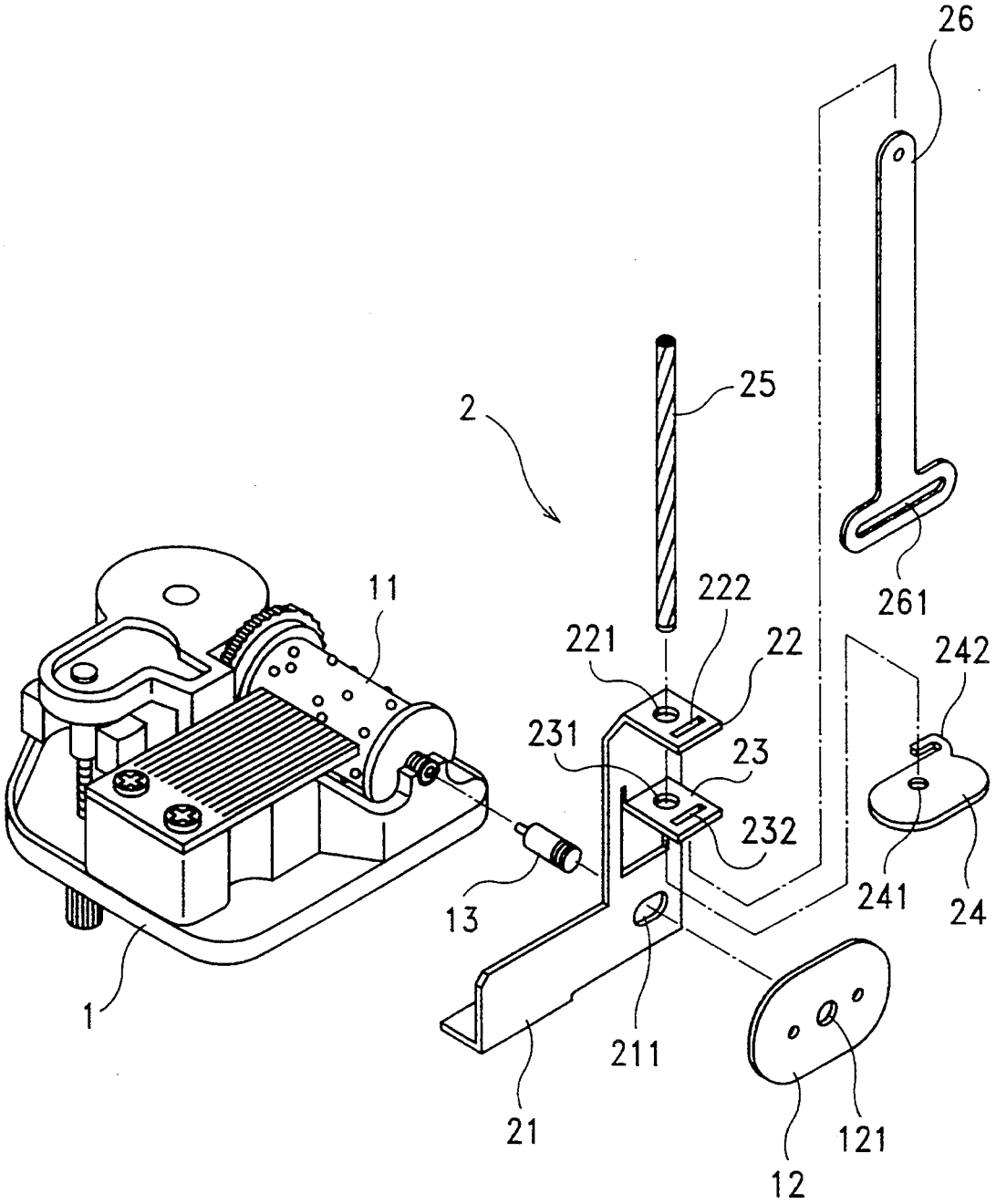
FIG. 3 is a perspective exploded view of the mechanical parts of a music box constructed according to a second embodiment of the present invention.
Figure 4:
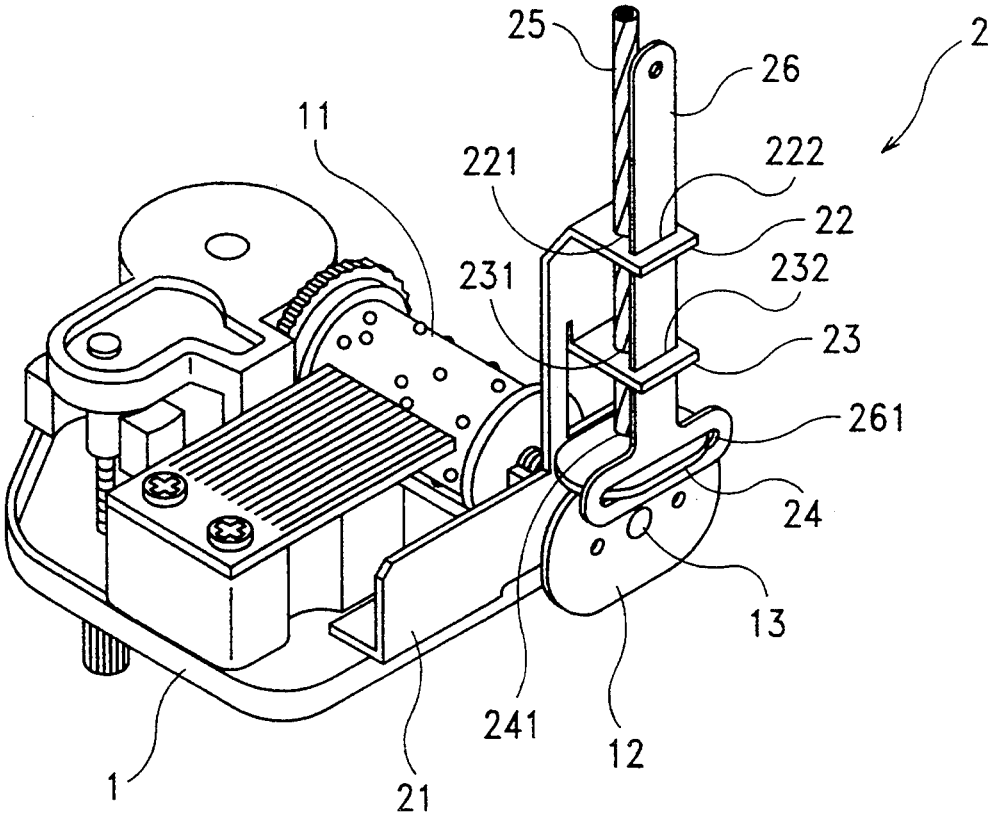
FIG. 4 is a perspective assembly view of the mechanical parts of the music box of FIG. 3.

Referring to FIGS. 3 and 4, therein illustrated is an alternate form of the present invention. This alternate form is similar to the mechanism shown in FIGS. 1 and 2. As illustrated, this alternate form comprises an inverted T-bar 26 having the end inserted from the bottom through a slot 232 on the lower horizontal plate 23 and a slot 222 on the upper horizontal plate 22 and then connected to an ornament (not shown), and the head mounted on the movable board 24 by a hanging hole 261 thereon. As the pinned barrel 11 is turned on to reproduce the music, the round rod 25 and the inverted T-bar 26 are simultaneously reciprocated to move the respective ornaments up and down.

Figure 5:
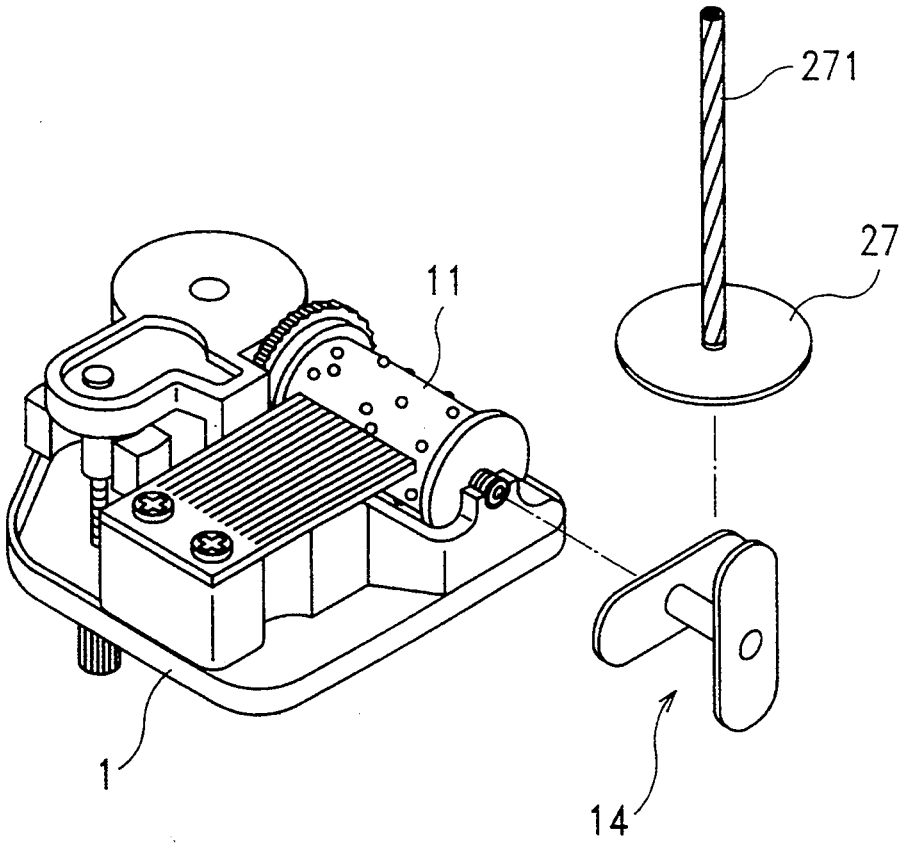
FIG. 5 is a perspective exploded view of the mechanical parts of a music box constructed according to a third embodiment of the present invention.
Figure 6:
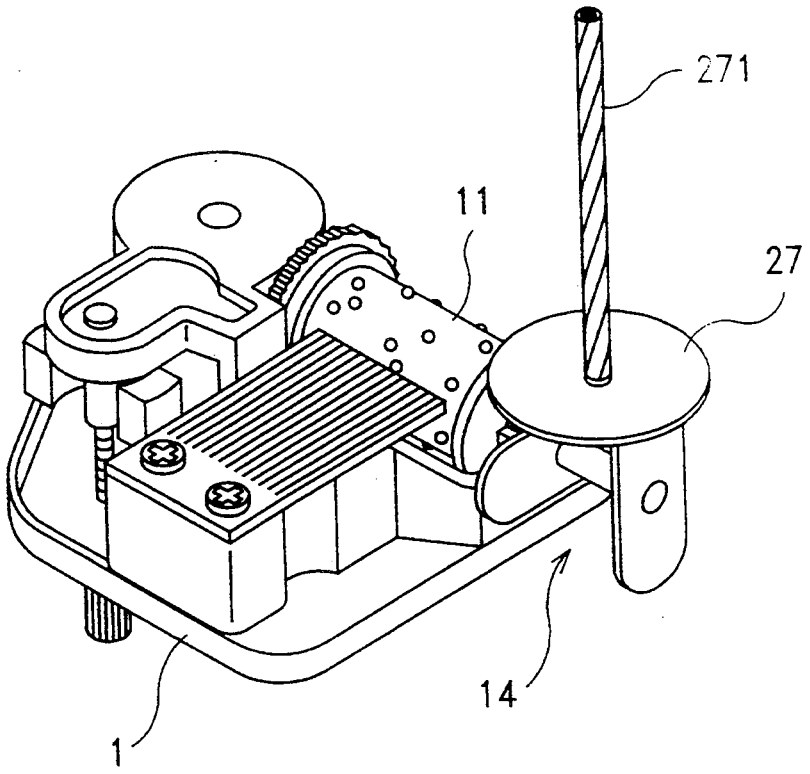
FIG. 6 is a perspective assembly view of the mechanical parts of the music box of FIG. 5.

Referring to FIGS. 5 and 6, therein illustrated is still another alternate form of the present invention. In this embodiment, two spaced cams 14 are joined by an axle coupled to the central shaft of the pinned barrel 11 and driven to alternatively reciprocate a movable horizontal circular board 27, which has an upright round rod 271 in the center to carry an ornament. The cams 14 are disposed at different angles so that they are turned to reciprocate the movable horizontal circular board 27 one after another.

What is claimed is:

1. A music box comprising:

a pinned barrel having a central shaft in the center thereof, and produces music when driven by a clock-work;

an extension axle longitudinally coupled to said central shaft of the pinned barrel;

a cam having a center hole fits with the opposite end of said extension axle;

an upright frame is fastened to the music box at one side, having an opening, through which said extension axle extends and connects to said cam, an upper horizontal plate at the top which has a through hole, and a lower horizontal plate between said upper horizontal plate and said opening, which has a through hole aligned with said through hole on said upper horizontal plate; and a round rod is inserted into said through holes and fitted into a moving device, said moving device is located above said cam.

2. The music box of claim 1 wherein said moving device comprises a movable board horizontally supported on said cam and said round rod coupled to an ornament.

3. The music box of claim 2 wherein said movable device further comprises an inverted T-bar having one end inserted through slots on said vertically spaced horizontal plates of said frame and an opposite end fixed on said movable board.

4. The music box of claim 1 wherein said cam is replaced with two joined cams driven by said pinned barrel alternatively to reciprocate and rotate said moving device one after another in variable direction and speed.

* * * * *